US010520213B2

(12) United States Patent
D'Souza et al.

(10) Patent No.: US 10,520,213 B2
(45) Date of Patent: Dec. 31, 2019

(54) AIR CONDITIONER UNITS AND METHODS OF OPERATION

(71) Applicant: Haier US Appliance Solutions, Inc., Wilmington, DE (US)

(72) Inventors: Bryan Isaac D'Souza, Louisville, KY (US); Richard Dustin Henderson, LaGrange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 237 days.

(21) Appl. No.: 15/795,465

(22) Filed: Oct. 27, 2017

(65) Prior Publication Data

US 2019/0128546 A1 May 2, 2019

(51) Int. Cl.

| | |
|---|---|
| ***F24F 11/83*** | (2018.01) |
| ***F24F 1/027*** | (2019.01) |
| ***F24F 11/30*** | (2018.01) |
| ***F24F 11/85*** | (2018.01) |
| ***F24F 110/20*** | (2018.01) |
| ***F24F 110/10*** | (2018.01) |

(52) U.S. Cl.

CPC ..... *F24F 11/83* (2018.01); *F24F 1/027* (2013.01); *F24F 11/30* (2018.01); *F24F 11/85* (2018.01); *F24F 2110/10* (2018.01); *F24F 2110/20* (2018.01)

(58) Field of Classification Search

CPC .. F24F 11/83; F24F 11/30; F24F 1/027; F24F 2110/20; F24F 11/85; F24F 2110/10; F24F 3/1405; F24F 2110/22; F24F 3/14

USPC ..... 165/225, 222, 200

See application file for complete search history.

(56) References Cited

U.S. PATENT DOCUMENTS

| | | | | |
|---|---|---|---|---|
| 4,018,584 | A * | 4/1977 | Mullen | F24F 11/30 62/175 |
| 5,129,234 | A * | 7/1992 | Alford | G05D 22/02 62/176.6 |
| 6,070,110 | A * | 5/2000 | Shah | F24F 11/0008 165/205 |
| 6,843,068 | B1 * | 1/2005 | Wacker | F24F 11/30 62/176.6 |
| 6,996,999 | B2 * | 2/2006 | Wacker | F24F 11/0008 165/225 |
| 2007/0257121 | A1 * | 11/2007 | Chapman | F24F 3/14 236/44 C |
| 2011/0195652 | A1 * | 8/2011 | Smith | H05K 7/20836 454/184 |

* cited by examiner

*Primary Examiner* — Justin M Jonaitis

(74) *Attorney, Agent, or Firm* — Dority & Manning, P.A.

(57) ABSTRACT

Air conditioner units, including methods of operation, are provided herein. The air conditioner unit may include an indoor portion, an outdoor portion, and a compressor in fluid communication between the indoor portion and the outdoor portion. The method may include setting an operating temperature of the indoor portion based on a primary temperature target, determining a humidity value at the indoor portion, comparing the determined humidity value to a humidity threshold, resetting the operating temperature as a temporary temperature target when the determined humidity value is above the humidity threshold and the primary temperature target is reached at the indoor portion of the air conditioner, and directing refrigerant compression at the compressor based on the operating temperature.

20 Claims, 15 Drawing Sheets

AIR CONDITIONER UNITS AND METHODS OF OPERATION

FIELD OF THE INVENTION

The present subject matter relates generally to air conditioner units and more particularly to air conditioner units configured for operating based on a determined humidity value.

BACKGROUND OF THE INVENTION

Air conditioner or conditioning units are conventionally utilized to adjust the temperature indoors—i.e., within structures such as dwellings and office buildings. Such units commonly include a closed refrigeration loop to heat or cool the indoor air. Typically, the indoor air is recirculated while being heated or cooled.

A variety of sizes and configurations are available for such air conditioner units. For example, some units may have one portion installed within the indoors that is connected, by e.g., tubing carrying the refrigerant, to another portion located outdoors. These types of units are typically used for conditioning the air in larger spaces.

Another type of unit, sometimes referred to as PTAC or a packaged terminal air conditioner unit, may be used for somewhat smaller indoor spaces that are to be air conditioned. These units may include both an indoor portion and an outdoor portion separated by a bulkhead but sharing a sealed cooling system. Moreover, these units may be supported within the same frame or casing. PTACs, for example, are sometimes installed in windows or positioned within an opening of an exterior wall of a building.

Along with temperature, many users rely on an air-conditioning unit to control humidity within an indoor environment. For example, as a refrigerant is cooled, moisture within the air may condensate such that the moisture may be removed as a liquid. In a conventional unit, such as a PTAC, it may be difficult for the unit to control both temperature and humidity simultaneously. For example, cooling or heating operations will generally affect both the temperature and the humidity level. However, it is possible for the settings for these criteria to conflict. For example, a temperature setting may be satisfied even though a humidity setting is not satisfied. Moreover, the indoor space may need to draw in air from the outdoors (i.e., make-up air). For example, if a vent fan is turned on in a bathroom or air is otherwise ejected from the indoor space, fresh air from an outdoor spaced is required. Air drawn from the outside as make-up air is often at the wrong temperature or humidity. In such case, it is undesirable to draw the air into the room with further conditioning, such as lowering the air's temperature and/or humidity.

In some instances, with or without the introduction of make-up air, it is possible for the unit to achieve a desirable temperature (e.g., temperature range) while still having an undesirably high humidity level. No further action may be necessary to maintain the desirable temperature, but further cooling (e.g., by running the sealed system to condense moisture) may be necessary to achieve a desirable humidity level. In some instances, these competing goals may be irreconcilable. In other instances, these competing goals may cause portions (e.g., a compressor) of the sealed cooling system to be excessively adjusted or cycled (e.g., off and on), decreasing efficiency and creating an undesirable noise or nuisance for users.

Accordingly, improved air conditioner units and associated methods for operation are desired. In particular, air conditioner units and associated methods that can enable improved temperature and humidity control would be useful. Such units that could also reduce noise and system complexity while improving efficiency would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method for operating a packaged terminal air conditioner unit is provided. The packaged terminal air conditioner unit may include an indoor portion, an outdoor portion, and a compressor in fluid communication between the indoor portion and the outdoor portion. The method may include setting an operating temperature of the indoor portion based on a primary temperature target, determining a humidity value at the indoor portion, comparing the determined humidity value to a humidity threshold, resetting the operating temperature as a temporary temperature target when the determined humidity value is above the humidity threshold and the primary temperature target is reached at the indoor portion of the air conditioner, and directing refrigerant compression at the compressor based on the operating temperature.

In another exemplary aspect of the present disclosure, an air conditioner unit for conditioning an indoor space is provided. The air conditioner unit may include an outdoor heat exchanger assembly, an indoor heat exchanger assembly, a compressor, a bulkhead, a vent aperture, a humidity sensor, a temperature sensor, and a controller. The outdoor heat exchanger assembly may be disposed in an outdoor portion and include an outdoor heat exchanger and an outdoor fan. The indoor heat exchanger assembly may be disposed in an indoor portion and include an indoor heat exchanger and an indoor fan. The compressor may be in fluid communication with the outdoor heat exchanger and the indoor heat exchanger to circulate a refrigerant between the outdoor heat exchanger and the indoor heat exchanger. The bulkhead may be disposed between the outdoor heat exchanger and the indoor heat exchanger along a transverse direction. The bulkhead may define the indoor portion and the outdoor portion. The vent aperture may be defined in the bulkhead. The humidity sensor may be disposed within the indoor portion. The temperature sensor may be disposed within the indoor portion. The controller may be operably coupled to the compressor. The controller may be configured to initiate a conditioning cycle. The conditioning cycle may include setting an operating temperature of the indoor portion based on a primary temperature target, determining a humidity value at the indoor portion based on a signal received from the humidity sensor, comparing the determined humidity value to a humidity threshold, resetting the operating temperature as a temporary temperature target when the determined humidity value is above the humidity threshold and the primary temperature target is reached at the indoor portion, and directing refrigerant compression at the compressor based on the operating temperature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
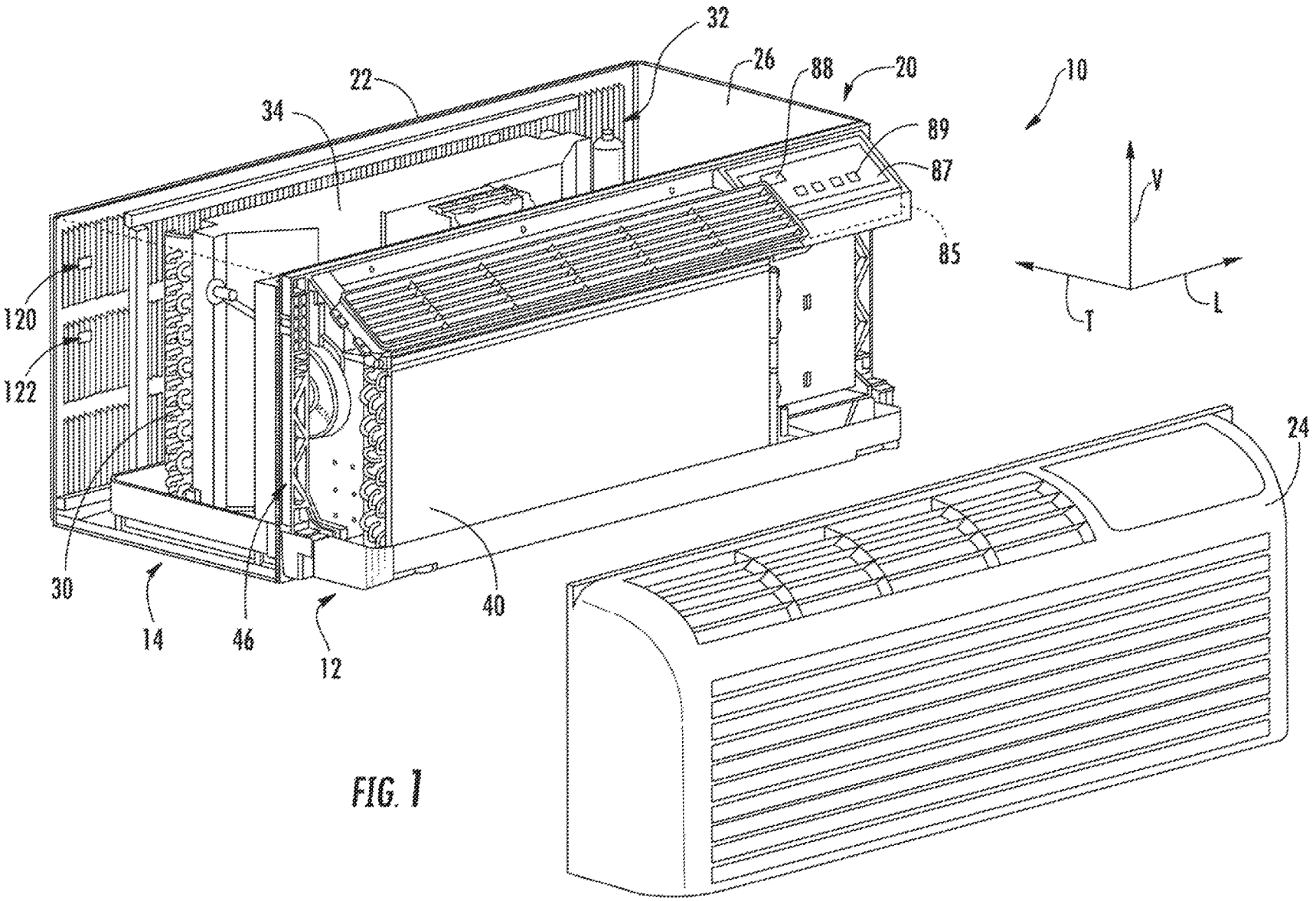
FIG. 1 provides a perspective view of an air conditioner unit, with part of an indoor portion exploded from a remainder of the air conditioner unit for illustrative purposes, in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure may provide an air conditioner unit, such as a packaged terminal air conditioner unit, that can treat or cool incoming air such that a desired temperature and humidity are achieved. For instance, the air conditioner unit may have a band of operating temperatures, such as a primary upper limit and a primary lower limit, based on a user-set temperature. The unit may thus operate keep incoming air within the operating temperature band. If a desired humidity level is not satisfied, the unit may temporarily reset the operating temperature band (e.g., as a temporary upper limit and a temporary lower limit). In other words, the unit may operate to keep incoming air within the reset operating temperature band until the desired humidity level is reached.

Referring now to FIG. 1, an air conditioner unit 10 is provided. The air conditioner unit 10 is a one-unit type air conditioner, also conventionally referred to as a room air conditioner or packaged terminal air conditioner unit (PTAC). The unit 10 includes an indoor portion 12 and an outdoor portion 14, and generally defines a vertical direction V, a lateral direction L, and a transverse direction T. Each direction V, L, T is perpendicular to the other directions, such that an orthogonal coordinate system is generally defined.

Figure 5:
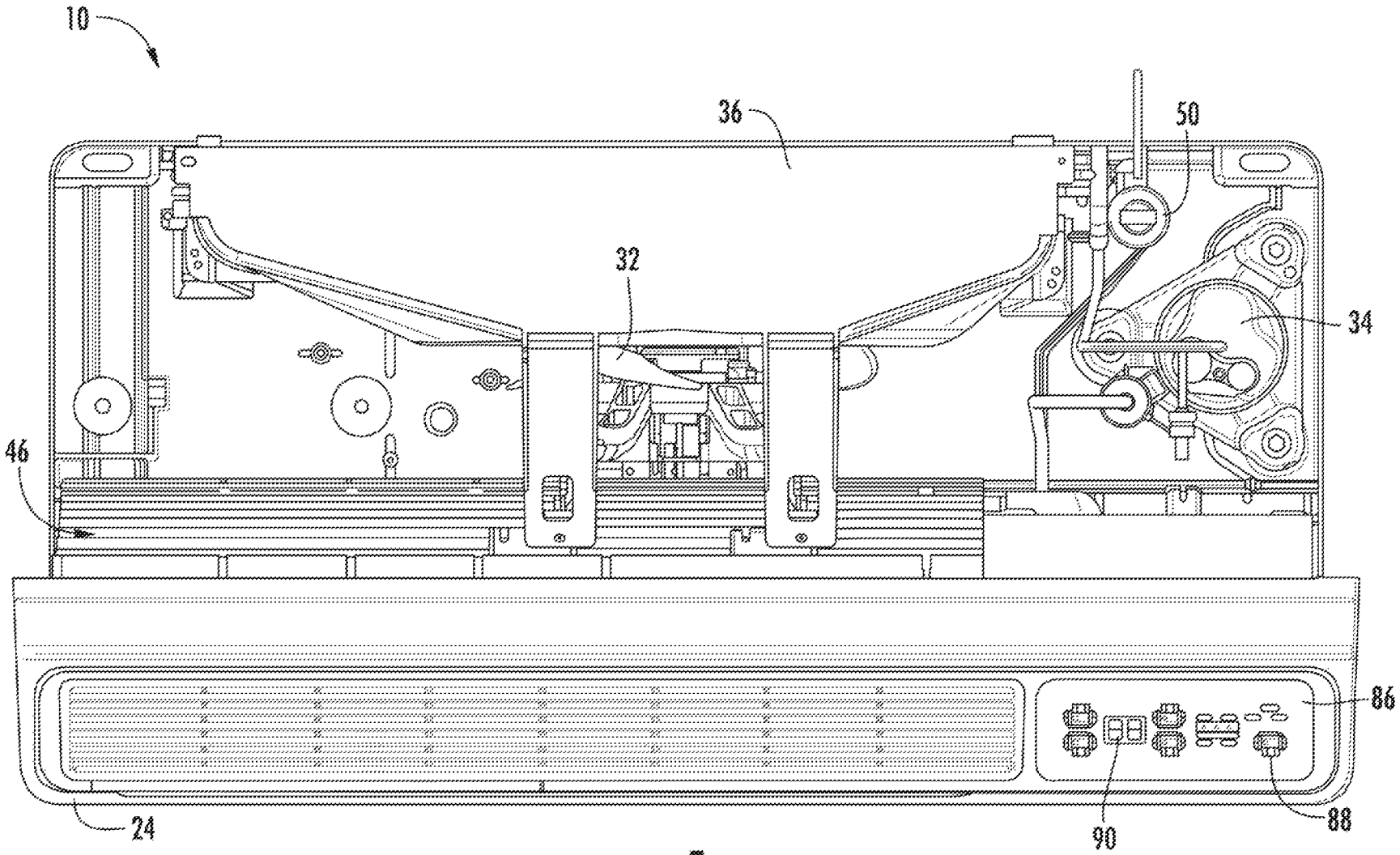
FIG. 5 provides a top view of components of an air conditioner unit in accordance with exemplary embodiments of the present disclosure.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, outdoor fan 32 (FIG. 5), and compressor 34 (FIG. 5) may be housed within the wall sleeve 26. A casing 36 may additionally enclose the outdoor fan, as shown.

Figure 2:
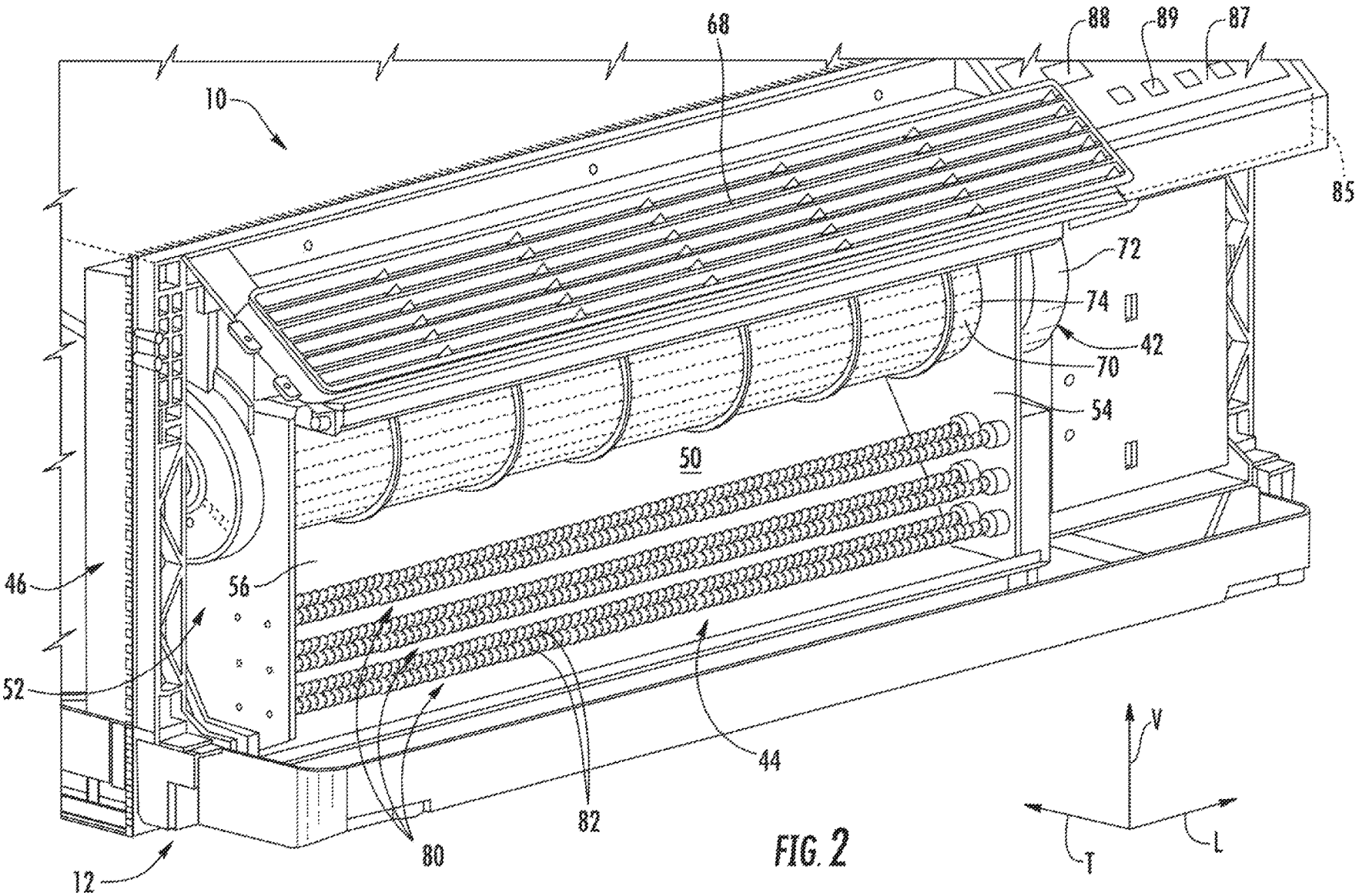
FIG. 2 provides a perspective view of components of an indoor portion of an air conditioner unit in accordance with exemplary embodiments of the present disclosure.

Referring now also to FIG. 2, indoor portion 12 may include, for example, an indoor heat exchanger 40, a blower fan 42, and a heating unit 44. These components may, for example, be housed behind the room front 24. Additionally, a bulkhead 46 may generally support and/or house various other components or portions thereof of the indoor portion 12, such as the blower fan 42 and the heating unit 44. Bulkhead 46 may generally separate and define the indoor portion 12 and outdoor portion 14.

Figure 3:
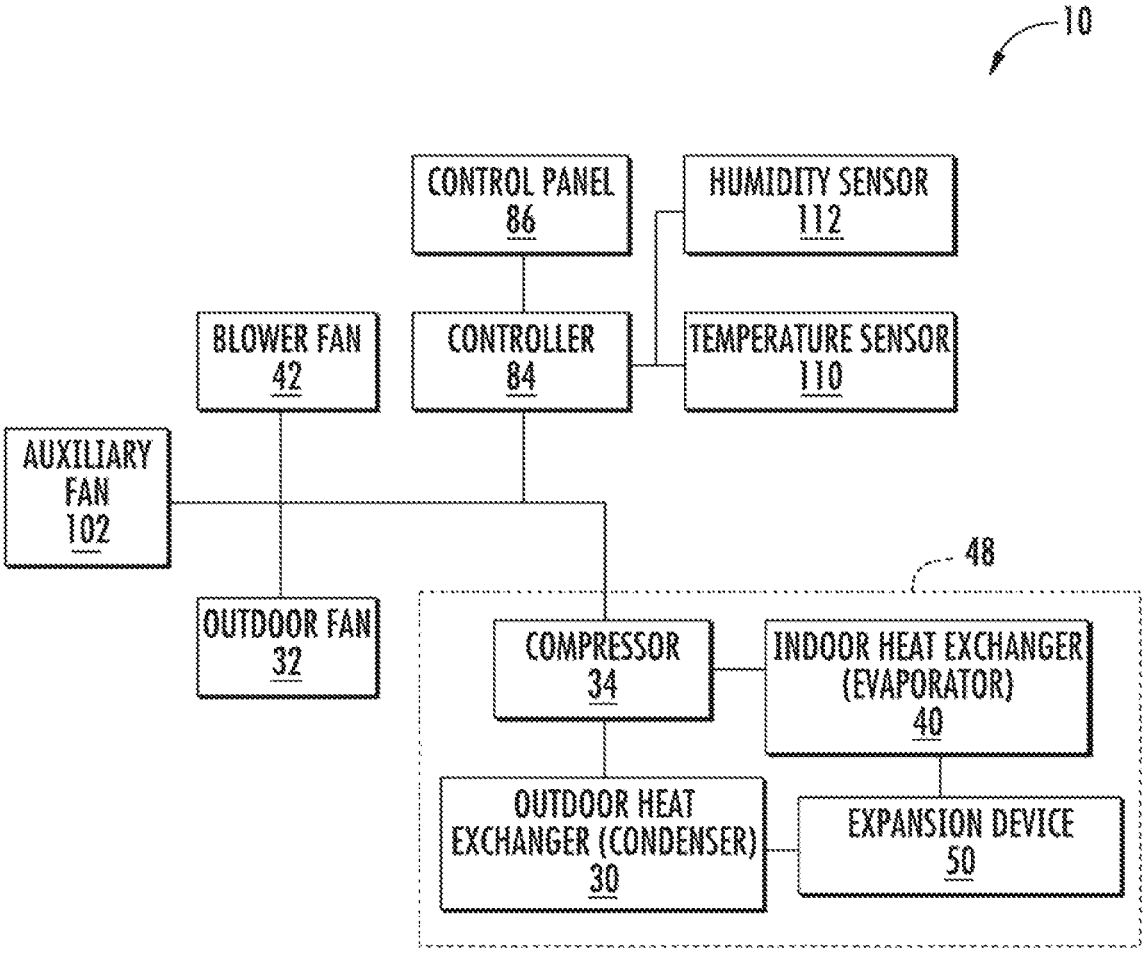
FIG. 3 provides a schematic view of a refrigeration loop in accordance with exemplary embodiments of the present disclosure.
Figure 6:
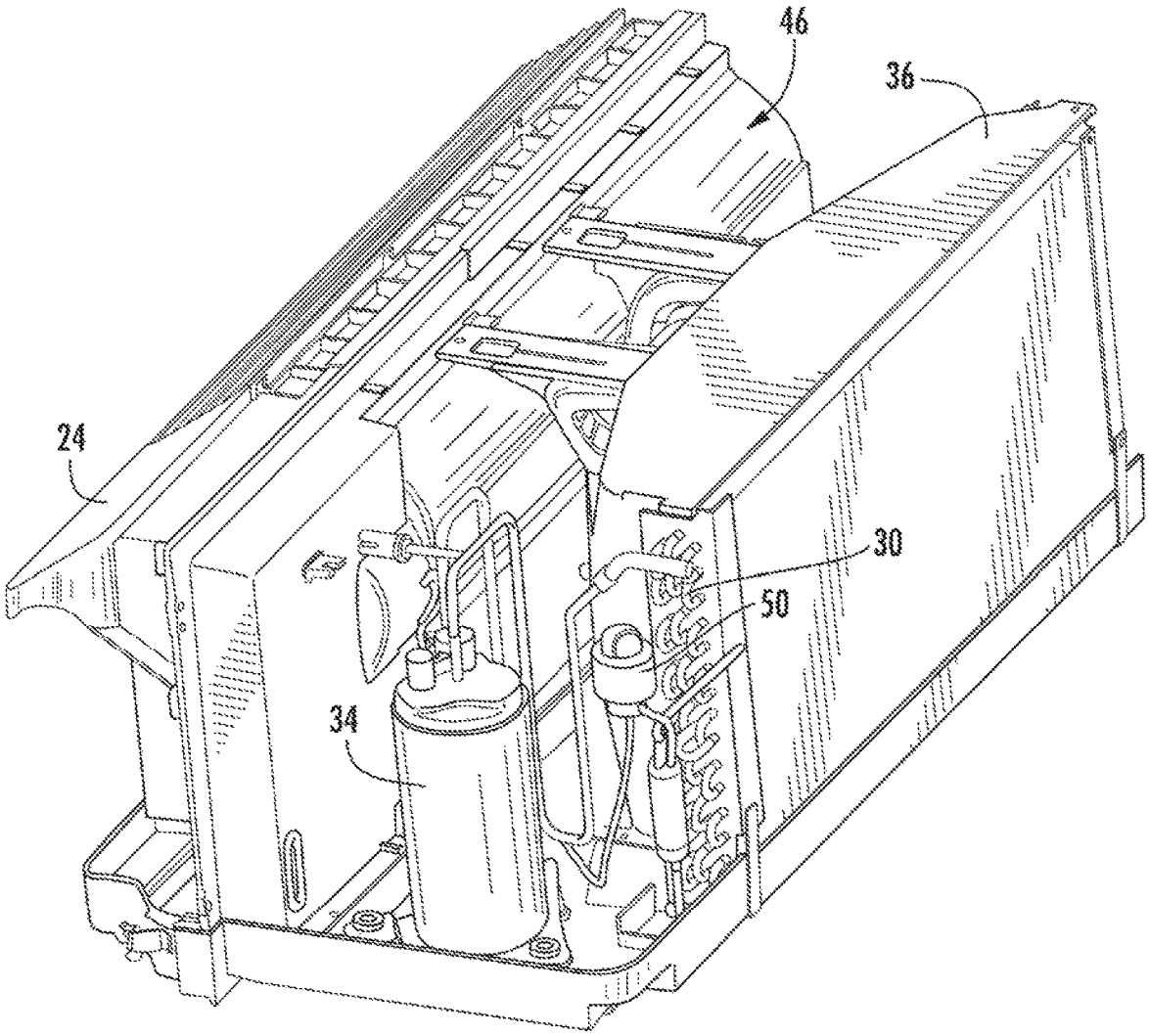
FIG. 6 provides a rear perspective view of components of an outdoor portion of an air conditioner unit in accordance with exemplary embodiments of the present disclosure.
Figure 7:
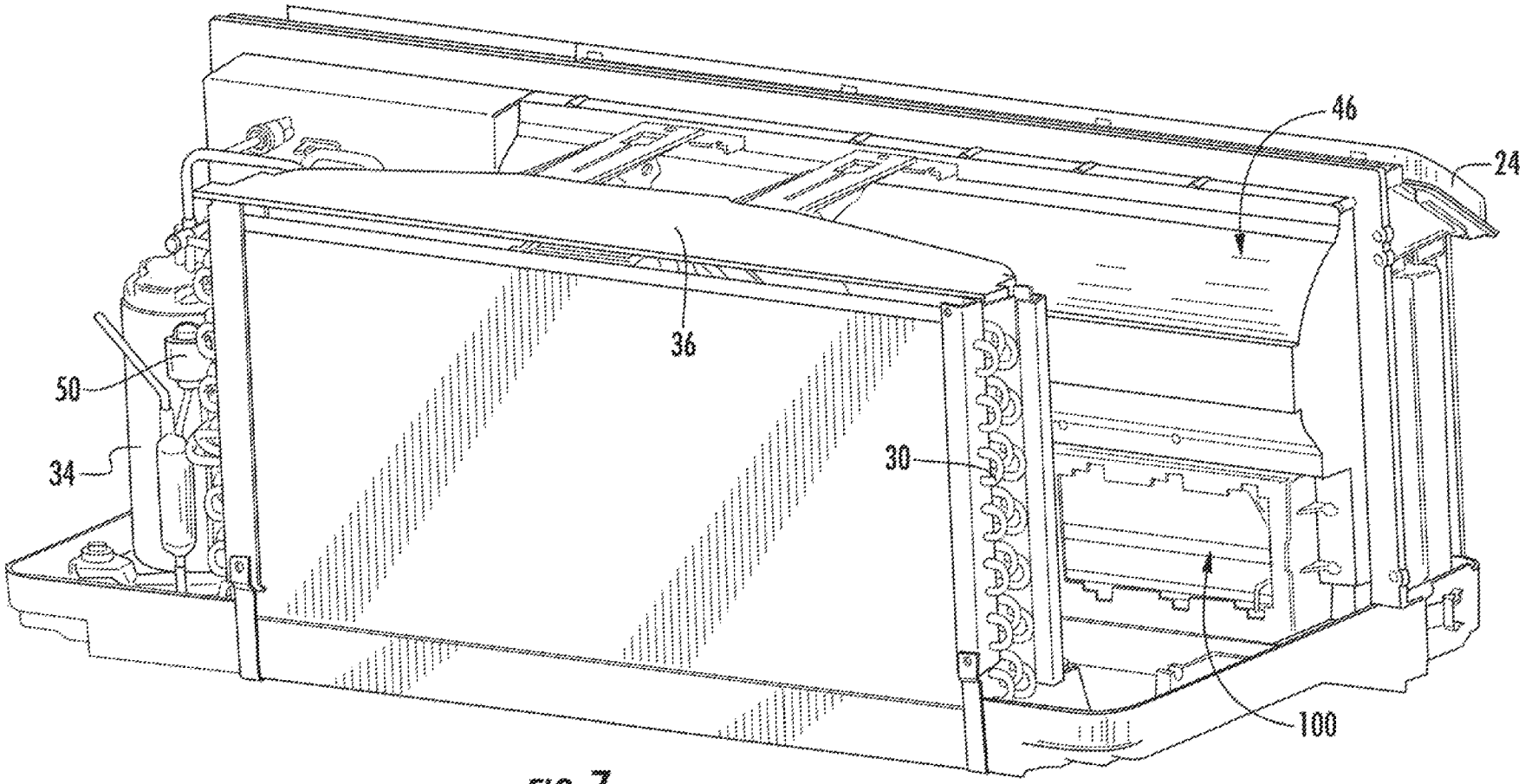
FIG. 7 provides a rear perspective view of components of an outdoor portion of an air conditioner unit in accordance with exemplary embodiments of the present disclosure.
Figure 8:
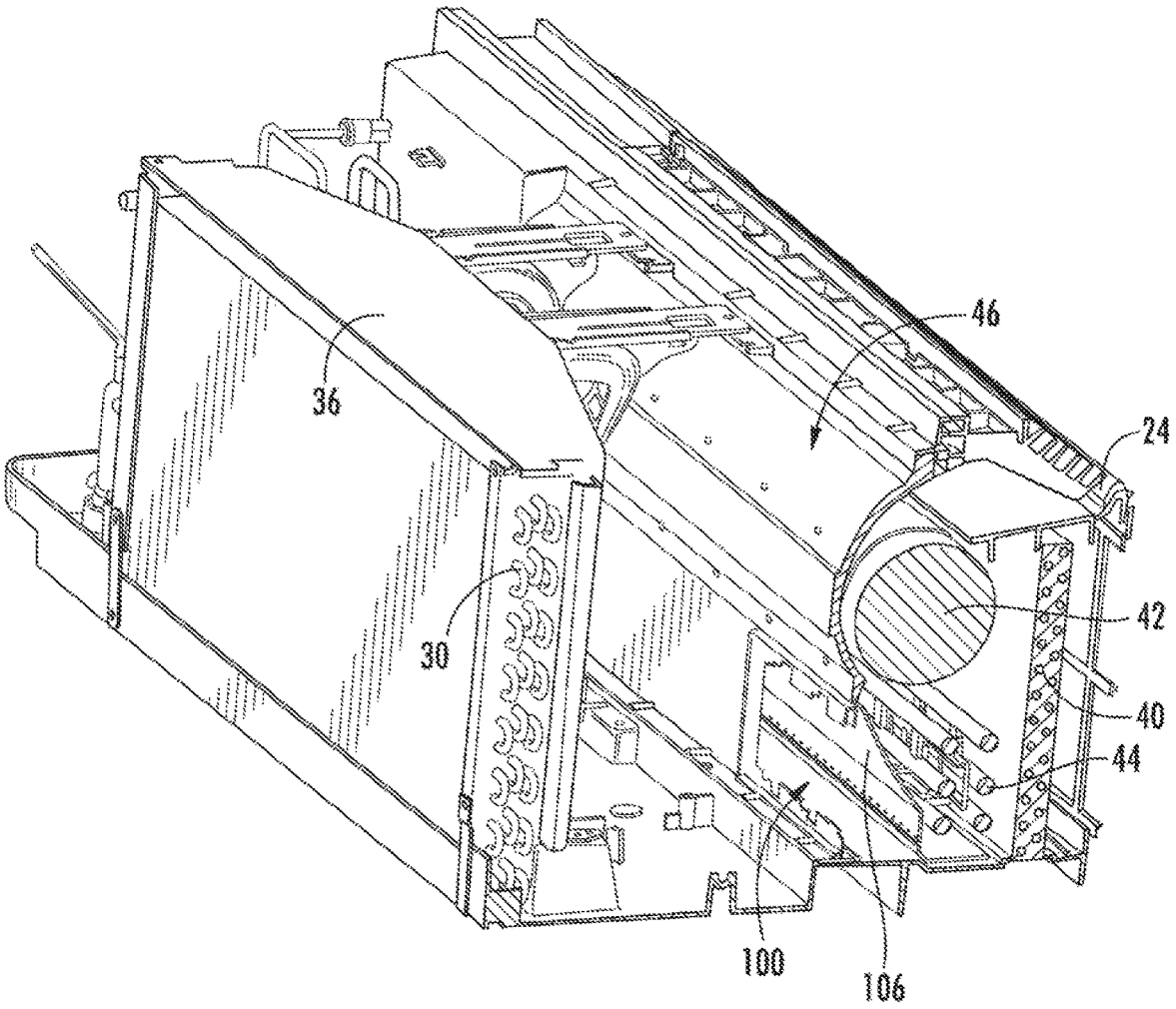
FIG. 8 provides a perspective section view of components of an air conditioner unit in accordance with exemplary embodiments of the present disclosure.

Outdoor and indoor heat exchangers 30, 40 may be components of a sealed refrigeration loop 48, which is shown schematically in FIG. 3. Refrigeration loop 48 may, for example, further include compressor 34 and an expansion device 50 (see also FIG. 6). As illustrated, compressor 34 and expansion device 50 may be in fluid communication with outdoor heat exchanger 30 and indoor heat exchanger 40 to flow refrigerant therethrough, as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. One suitable refrigerant for use in refrigeration loop 48 is 1,1,1,2-Tetrafluoroethane, also known as R-134A, although it should be understood that the present disclosure is not limited to such example and rather that any suitable refrigerant may be utilized.

During operations of unit 10, refrigeration loop 48 may perform one or more conditioning cycle. For instance, refrigeration loop 48 may be alternately operated as a refrigeration assembly (and thus perform a refrigeration cycle) or a heat pump (and thus perform a heat pump cycle). As shown in FIG. 3, when refrigeration loop 48 is operating in a cooling mode, and thus performs a refrigeration cycle (e.g., during a cooling routine or a dehumidification routine), the indoor heat exchanger 40 acts as an evaporator and the outdoor heat exchanger 30 acts as a condenser. Alternatively, when refrigeration loop 48 is operating in a heating mode, and thus performs a heat pump cycle (e.g., during a heating routine), the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

In some embodiments, compressor 34 is a variable speed compressor. In this regard, compressor 34 may be operated at various speeds depending on the current air conditioning needs of the room (i.e., the room in which the indoor portion 12 is disposed) and the demand from refrigeration loop 48. For example, compressor 34 may be configured to operate at any speed between a minimum speed, e.g., 1500 revolutions per minute (RPM), to a maximum rated speed, e.g., 3500 RPM. In some embodiments, use of variable speed compressor 34 enables efficient operation of refrigeration loop 48 (and thus air conditioner unit 10), minimizes unnecessary noise when compressor 34 does not need to operate at full speed, and ensures a comfortable environment within the corresponding room. For instance, compressor 34 may operate (e.g., rotate) at a relatively high speed during a cooling or heating routine. By contrast, compressor may operate at a relatively low speed during a dehumidification routine. During a dehumidification routine, moisture within the air may thus be condensed at the indoor heat exchanger 40 without excessively reducing the temperature thereof.

As shown, expansion device 50 may be disposed in the outdoor portion 14 between the indoor heat exchanger 40 and the outdoor heat exchanger 30. In some embodiments, expansion device 50 is an electronic expansion valve that generally enables controlled expansion of refrigerant. More specifically, electronic expansion device 50 may be configured to precisely control the expansion of the refrigerant to maintain, for example, a desired temperature differential of the refrigerant across the indoor heat exchanger 40. In other words, electronic expansion device 50 selectively throttles the flow of refrigerant based on the reaction of the temperature differential across indoor heat exchanger 40 or the amount of superheat temperature differential, thereby ensuring that the refrigerant is in the gaseous state entering compressor 34. In alternative embodiments, expansion device 50 may be a capillary tube or another suitable expansion device configured for use in a thermodynamic cycle.

Bulkhead 46 may include various peripheral surfaces that define an interior 52 thereof. For example, and additionally referring to FIG. 4, bulkhead 46 may include a first sidewall 54 and a second sidewall 56 that are spaced apart from each other along the lateral direction L. A rear wall 58 may extend laterally between the first sidewall 54 and second sidewall 56. The rear wall 58 may, for example, include an upper portion 60 and a lower portion 64. Lower portion 64 may have a generally linear cross-sectional shape, and may be positioned below upper portion 60 along the vertical direction V. Rear wall 58 may further include an indoor facing surface and an opposing outdoor facing surface. The indoor facing surface may face the interior 52 and indoor portion 12, and the outdoor facing surface may face the outdoor portion 14. Bulkhead 46 may additionally extend between a top end 62 and a bottom end 66 along the vertical direction V. Upper portion 60 may, for example, include top end 62, while lower portion 64 may, for example, include bottom end 66. Bulkhead 46 may additionally include, for example, an air diverter 68, which may extend between the sidewalls 54, 56 along the lateral direction L and which may flow air therethrough.

Upper portion 60 may have a generally curvilinear cross-sectional shape, and may accommodate a portion of the blower fan 42, which may be, for example, a centrifugal fan. Alternatively, however, any suitable fan type may be utilized. As shown, blower fan 42 may include a blade assembly 70 and a motor 72. The blade assembly 70, which may include one or more blades disposed within a fan housing 74, may be disposed at least partially within the interior 52 of the bulkhead 46, such as within the upper portion 60. Moreover, blade assembly 70 may, for example, extend along the lateral direction L between the first sidewall 54 and the second sidewall 56. The motor 72 may be connected to the blade assembly 70, such as through the housing 74 to the blades via a shaft. Operation of the motor 72 may rotate the blades, thus generally operating the blower fan 42. Further, in exemplary embodiments, motor 72 may be disposed exterior to the bulkhead 46. Accordingly, the shaft may for example extend through one of the sidewalls 54, 56 to connect the motor 72 and blade assembly 70.

Notably, according to exemplary embodiments, outdoor fan 32 and blower fan 42 are variable speed fans. For example, referring to blower fan 42, motor 72 may be configured to rotate blade assembly 70 at different rotational speeds, thereby generating different air flow rates through blower fan 42. In some instances, it may be desirable to operate fans 32, 42 at less than their maximum rated speed to ensure safe and proper operation of refrigeration loop 48 at less than its maximum rated speed (e.g., in order to reduce noise when full speed operation is not needed and/or during a dehumidification routine). In addition, fans 32, 42 may be operated to urge make-up air into the room.

In some embodiments, blower fan 42 may operate as an evaporator fan in refrigeration loop 48 to encourage the flow of air through indoor heat exchanger 40. Accordingly, blower fan 42 may be positioned downstream of indoor heat exchanger 40 along the flow direction of indoor air and downstream of heating unit 44 along the flow direction of outdoor air (when make-up air is being supplied). Alternatively, blower fan 42 may be positioned upstream of indoor heat exchanger 40 along the flow direction of indoor air, and may operate to push air through indoor heat exchanger 40.

In certain embodiments, heating unit 44 includes one or more supplemental heat devices, such as heater banks 80. Each heater bank 80 may be operated as desired to produce heat. As illustrated, three heater banks 80 may be utilized in exemplary embodiments. Alternatively, however, any suitable number of heater banks 80 may be utilized. Each heater bank 80 may further include at least one heater coil or coil pass 82 (e.g., two heater coils or coil passes 82). Additionally or alternatively, other suitable heating elements may be utilized.

The operation of air conditioner unit 10 including compressor 34 (and thus refrigeration loop 48 generally), blower fan 42, outdoor fan 32 (FIG. 9), heating unit 44, expansion device 50, and other components of refrigeration loop 48 may be controlled by a processing device, such as a controller 84. Controller 84 may be operably coupled (via for example a suitable wired or wireless connection) to such components of the air conditioner unit 10. By way of example, the controller 84 may include a memory (e.g., non-transitive storage media) and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

In some embodiments, unit 10 includes a control panel 86 and one or more user inputs 88, which may be included in control panel 86. The user inputs 88 may be operably coupled to the controller 84. A user of the unit 10 may interact with the user inputs 88 to operate the unit 10, and user commands may be transmitted (e.g., as command signals) between the user inputs 88 and controller 84 to facilitate operation of the unit 10 based on such user commands. In particular, a unit may select a temperature input or relative amount of cooling/heating at control panel 86. A display 90 may additionally be provided in the control panel 86, and may be operably coupled to the controller 84. Display 90 may, for example be a touchscreen or other text-readable display screen, or alternatively may simply be a light that can be activated and deactivated as required to provide an indication of, for example, an event or setting for the unit 10.

Figure 4:
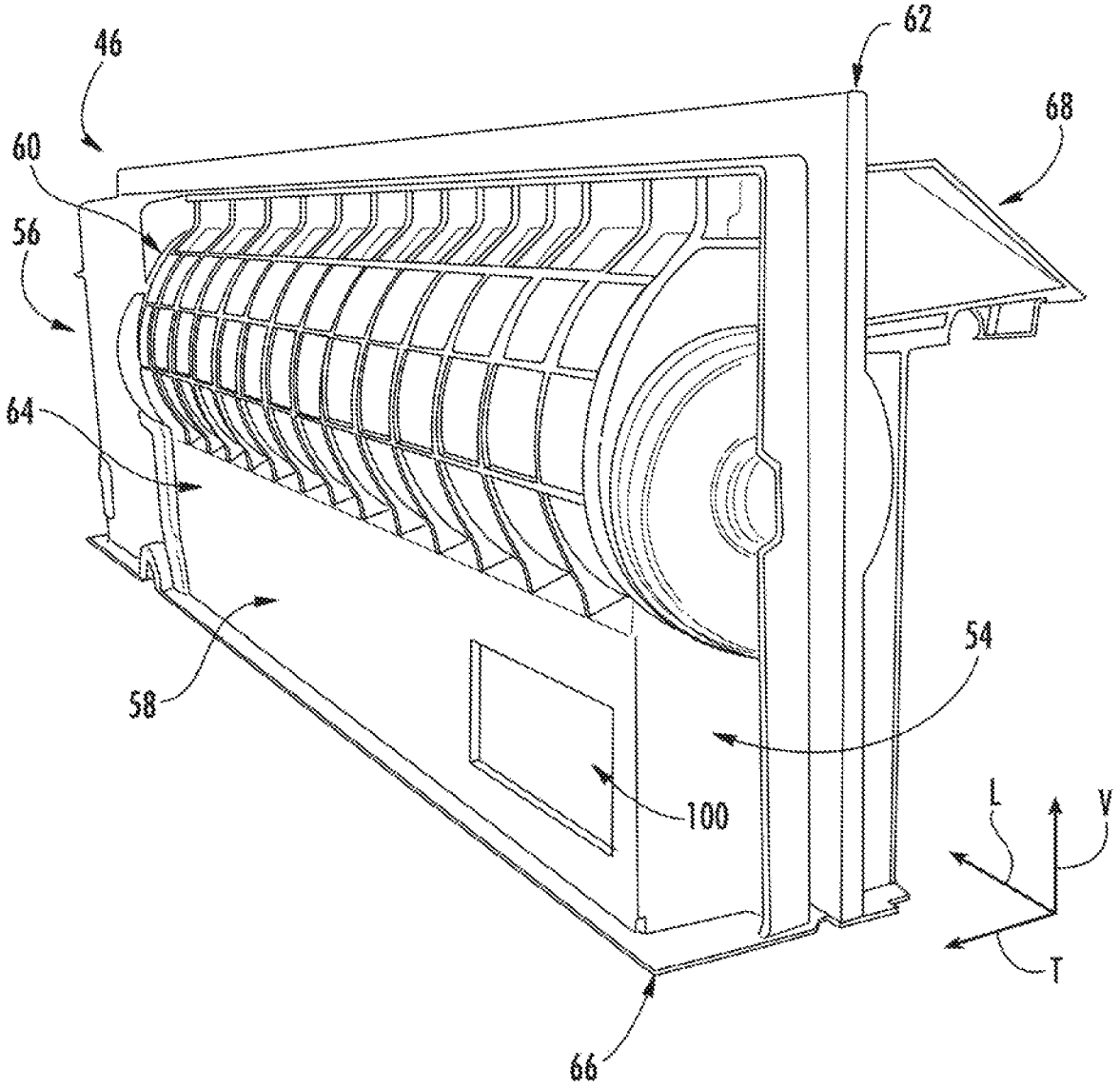
FIG. 4 provides a rear perspective view of a bulkhead assembly in accordance with exemplary embodiments of the present disclosure.

Referring briefly to FIG. 4, a vent aperture 100 may be defined in the rear wall 58 of bulkhead 46. Vent aperture 100 may allow air flow therethrough between the indoor portion 12 and outdoor portion 14, and may be utilized in an installed air conditioner unit 10 to allow outdoor air to flow therethrough into the room through the indoor portion 12. In this regard, in some cases it may be desirable to allow outside air to flow into the room in order to compensate for negative pressure created within the room by, for example, turning on a separate room fan (e.g., bathroom fan—not pictured). In this manner, outside air (i.e., make-up air) may be provided into the room through the vent aperture 100 of exemplary embodiments when a negative pressure is created as air is drawn out of the room by the separate room fan.

Referring now to FIGS. 4 through 11, in some instances, blower fan 42 and outdoor fan 32 may be used to provide make-up air into the room when desired. Additionally or alternatively, however, air conditioner unit 10 may further include an auxiliary fan 102 (see FIGS. 10 and 11) that may be used with refrigeration loop 48 force additional outdoor air through vent aperture 100. As shown, auxiliary fan 102 may be positioned within outdoor portion 14 proximate to vent aperture 100. Moreover, auxiliary fan 102 may be partially or wholly disposed in vent aperture 100 or partially or wholly disposed in indoor portion 12. Accordingly, auxiliary fan 102 may induce a flow of make-up air through vent aperture 100 to the indoor portion 12.

Figure 11:
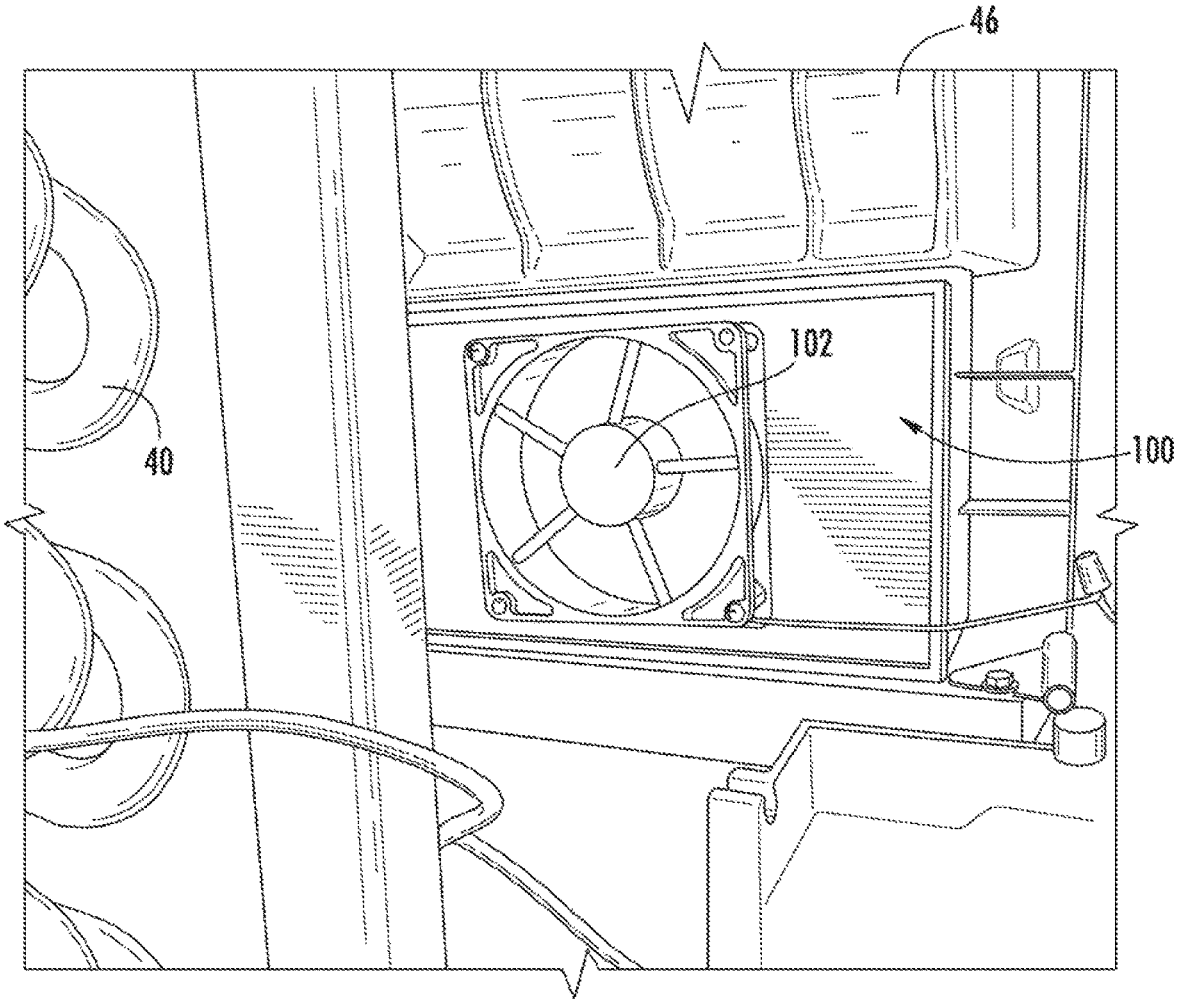
FIG. 11 provides a rear perspective view of an auxiliary fan positioned within a vent aperture in accordance with on embodiment of the present disclosure.

As illustrated in FIG. 11, in exemplary embodiments, auxiliary fan 102 is a single fan disposed within vent aperture 100. Notably, if auxiliary fan 102 does not cover the entire vent aperture 100, gaps may allow air to flow around auxiliary fan 102 into indoor portion 12. In circumstances where it is desirable to force all outdoor air through auxiliary fan 102, covers may be placed over these gaps to prevent flow around auxiliary fan 102. According to other exemplary embodiments, more than one auxiliary fan may be used. In additional or alternative embodiments, a screen is positioned over vent aperture 100 to capture and bugs or large particles in the flow of make-up air.

Figure 10:
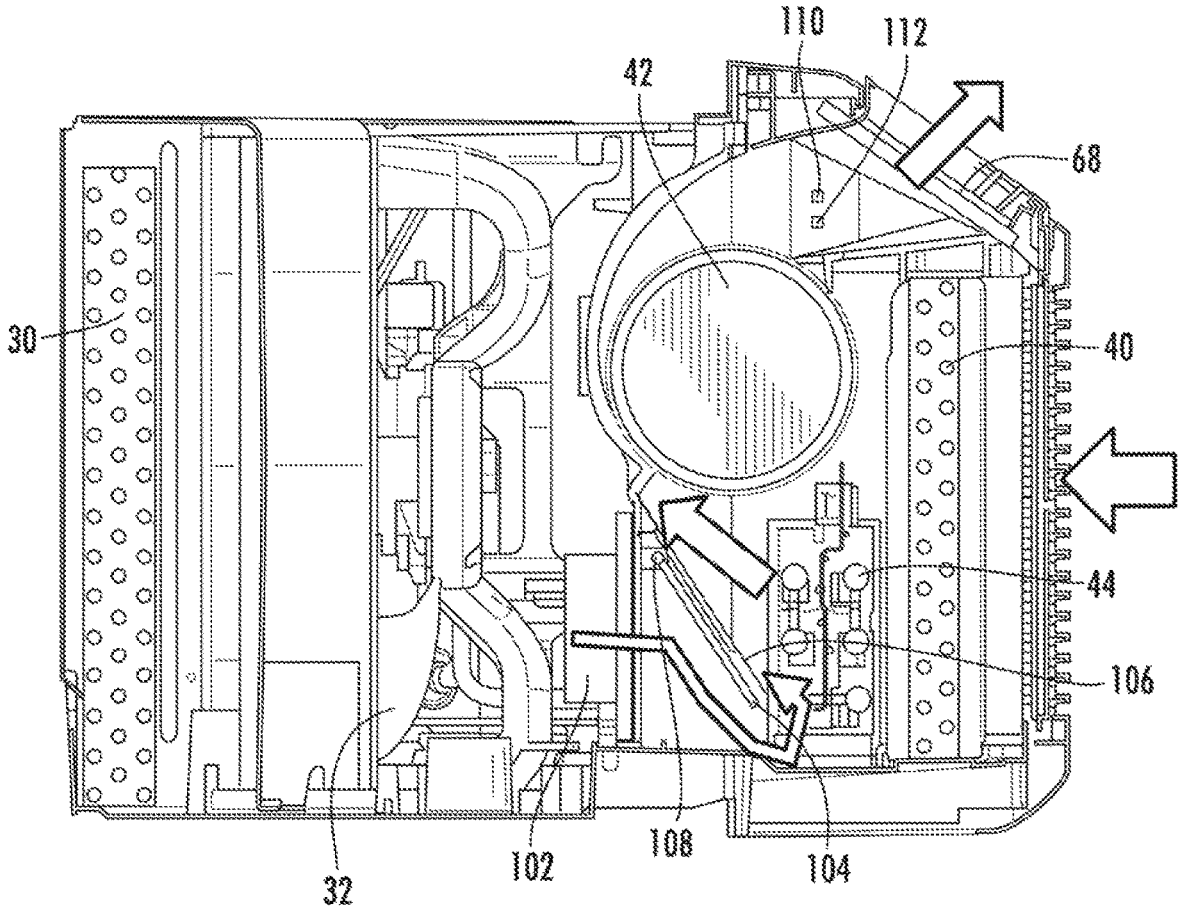
FIG. 10 provides a side section view of components of an air conditioner unit in accordance with exemplary embodiments of the present disclosure.

In some embodiments, a damper 104 may be pivotally mounted to the bulkhead 46 proximate to vent aperture 100 to open and close vent aperture 100. More specifically, in exemplary embodiments, such as those illustrated in FIG. 10, damper 104 is pivotally mounted to the indoor facing surface of indoor portion 12. Damper 104 may be configured to pivot between a first, closed position where damper 104 prevents air from flowing between outdoor portion 14 and indoor portion 12, and a second, open position where damper 104 is positioned parallel to a heat shield 106 (as shown in FIG. 10) and allows make-up air to flow into the room (e.g., after passing through the indoor portion 12). Optionally, damper 104 may be pivoted between the open and closed position by an electric motor 108 controlled by controller 84, or by any other suitable method.

Figure 9:
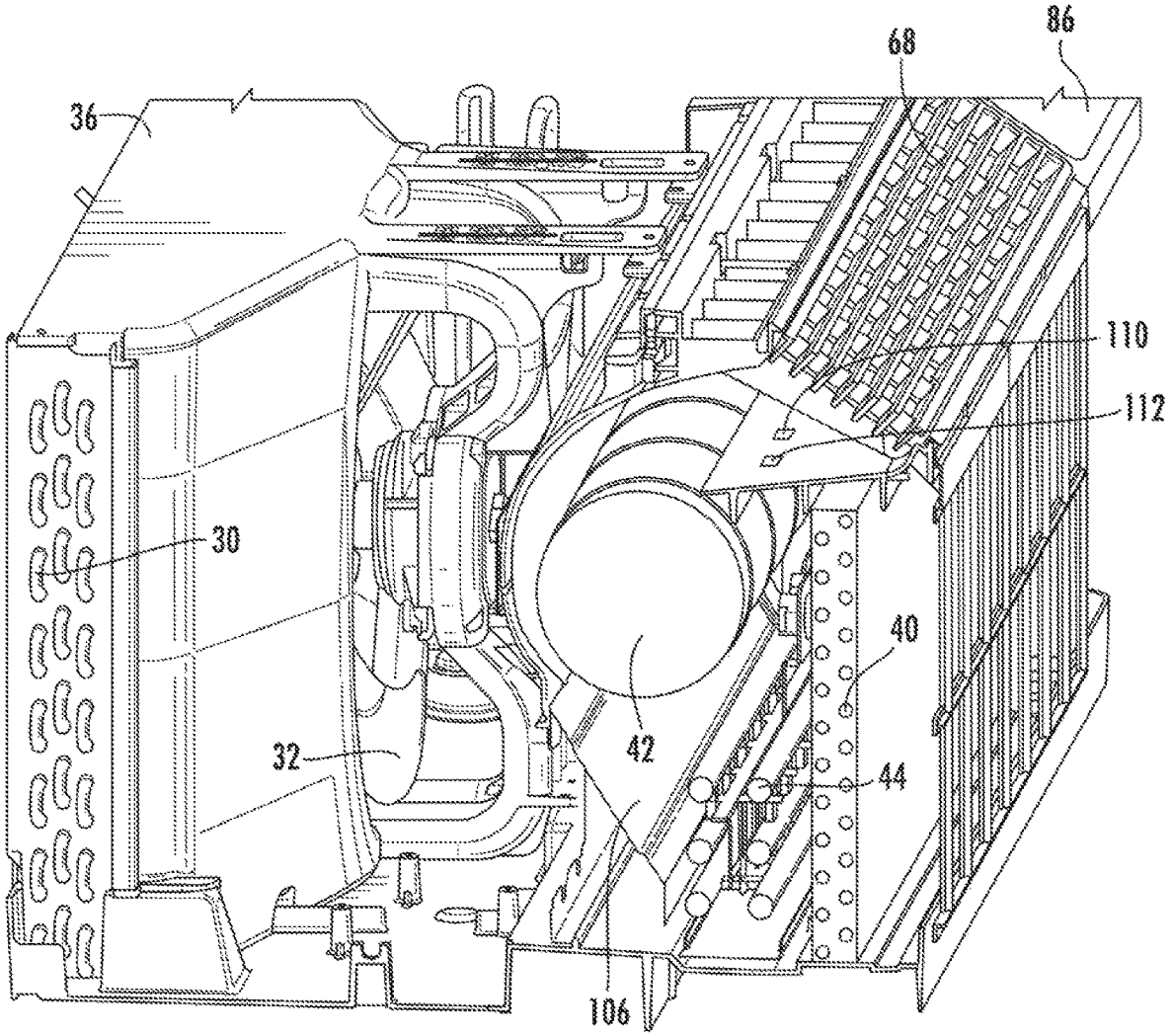
FIG. 9 provides a perspective section view of components of an air conditioner unit in accordance with exemplary embodiments of the present disclosure.

Referring now to FIGS. 9 and 10, air conditioner unit 10 may further include one or more sensors operably coupled (e.g., electrically or wirelessly coupled) to controller 84 to transmit and/or receive signals to/from controller 84. In turn, the sensors may be used to facilitate operation of unit 10. Generally, the sensors may be used for measuring the temperature, pressure, humidity, or other conditions at any suitable locations within unit 10 or in the ambient environment (e.g., the environment within the room).

In some embodiments, unit 10 includes a temperature sensor 110 disposed on or within indoor portion 12. Temperature sensor 110 may be any suitable temperature sensor 110. For example, temperature sensor 110 may be a thermocouple, a thermistor, or a resistance temperature detector. Moreover, temperature sensor 110 may be generally configured to detect measure the temperature of air within the indoor portion (e.g., the temperature of make-up air). For instance, temperature sensor 110 may be configured to transmit one or more temperature signals to controller 84 corresponding to the temperature detected at sensor 110. As shown, temperature sensor 110 may be positioned downstream of blower fan 42 (e.g., proximate air diverter 68). However, in additional or alternative embodiments, a temperature sensor (not pictured) may be placed proximate to vent aperture 100 to detect or measure the temperature of the make-up air flowing through vent aperture 100.

In some embodiments, unit 10 includes a humidity sensor 112 disposed on or within indoor portion 12 (e.g., proximate temperature sensor 110). Humidity sensor 112 may be any suitable humidity sensor 112. For example, humidity sensor 112 may be a capacitive, resistive, or thermal conductivity humidity sensor 112. Moreover, humidity sensor 112 may be generally configured to detect measure the humidity of air within the indoor portion (e.g., the temperature of make-up air). For instance, humidity sensor 112 may be configured to transmit one or more humidity signals to controller 84 corresponding to the humidity detected at sensor 112. As shown, humidity sensor 112 may be positioned downstream of blower fan 42 (e.g., proximate air diverter 68). However, in additional or alternative embodiments, another humidity sensor (not pictured) may be placed proximate to vent aperture 100 to detect or measure the humidity of the make-up air flowing through vent aperture 100.

Figure 12:
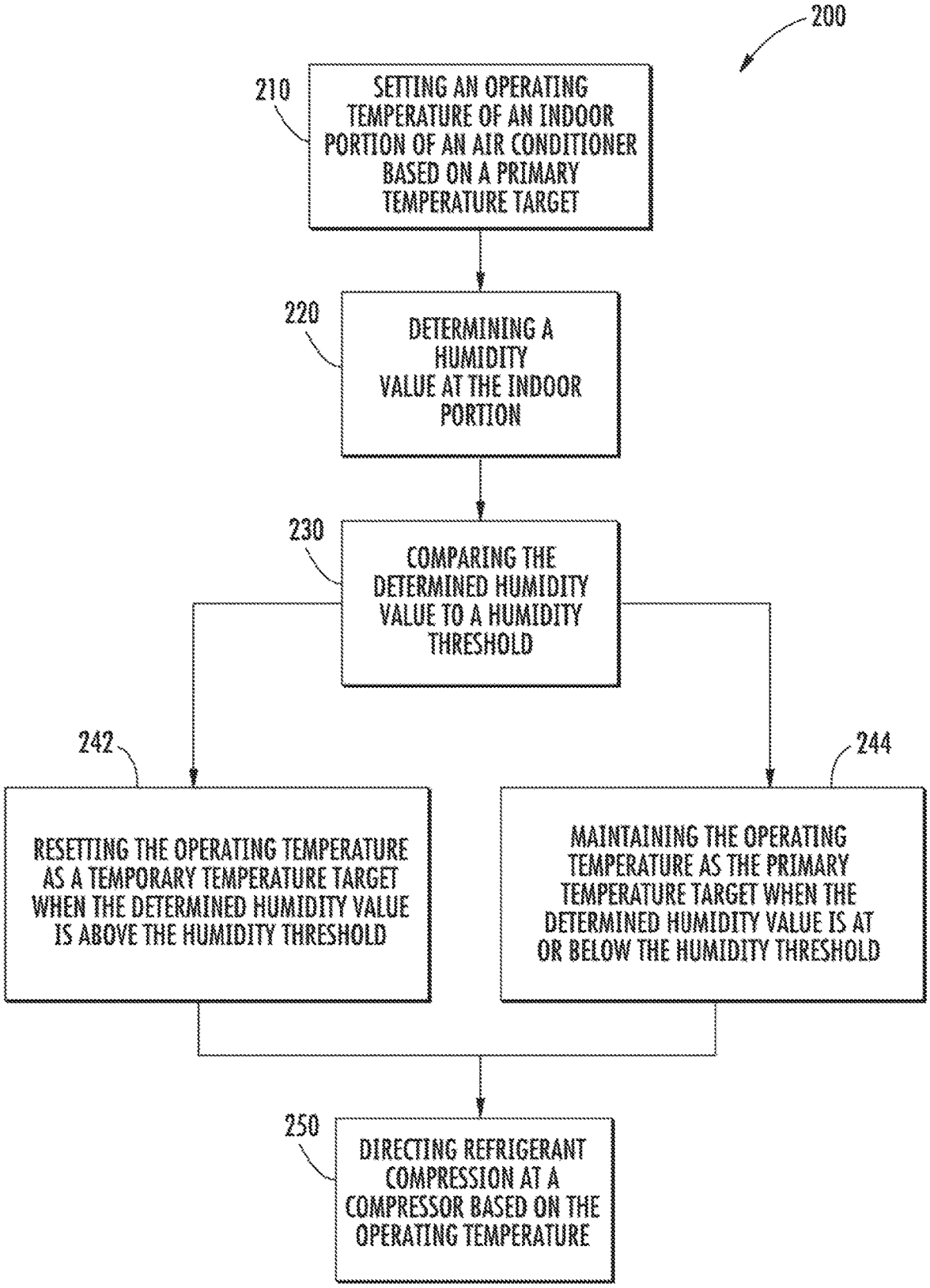
FIG. 12 provides a flow chart illustrating a method for operating an air conditioner unit in accordance with exemplary embodiments of the present disclosure.
Figure 15:
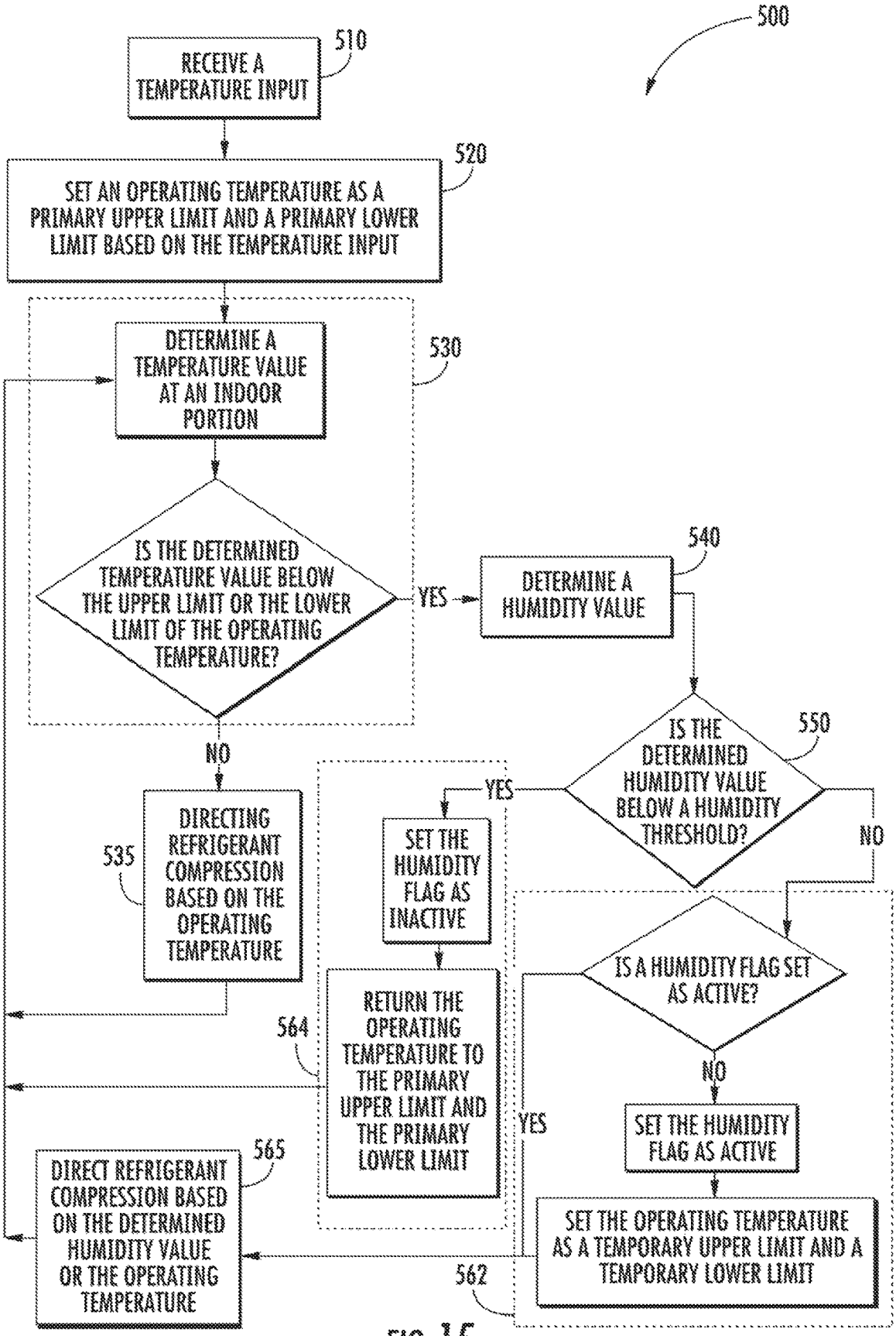
FIG. 15 provides a flow chart illustrating a method for operating an air conditioner unit in accordance with exemplary embodiments of the present disclosure.

Turning now to FIGS. 12 and 15, exemplary methods 200 and 500 of operating an air conditioner (e.g., air conditioning unit 10) are illustrated. Although the discussion below refers to exemplary methods 200 and 500 of operating air conditioner unit 10, one skilled in the art will appreciate that the exemplary methods 200 and 500 are applicable to the operation of a variety of other air conditioning appliances having different configurations.

In exemplary embodiments, the various method steps as disclosed herein may be performed by controller 84 as part of a conditioning cycle (e.g., refrigeration cycle or heat pump cycle) that controller 84 is configured to initiate. During some such methods, controller 84 may receive inputs and transmit outputs from various other components of unit 10. For example, controller 84 may send signals to and receive signals from control panel 86 (e.g., at user inputs 88), indoor blower fan 42, outdoor fan 32, temperature sensor 110, humidity sensor 112, heater unit 44 (e.g., at heater banks 80), auxiliary fan 102, damper 104, and/or refrigeration loop 48 (e.g., at compressor 34 and/or expansion device 50). In particular, the present disclosure is further directed to methods, such as method 200 or 500, for operating the air conditioner unit 10. Such methods may advantageously facilitate improved operation, noise reduction, and increased efficiency. For example, the below described methods may advantageously and efficiently establish desirable temperature and humidity levels within the room (or for air flowing thereto) without risking establishing conflicting instructions (e.g., at the controller) or excessively cycling one or more portion of the air conditioner unit, such as refrigeration loop 48 and compressor 34.

Although FIGS. 12 and 15 depict steps performed in a particular order for purpose of illustration and discussion. Those of ordinary skill in the art, using the disclosures provided herein, will understand that (except as otherwise indicated) the steps of any of the methods disclosed herein can be modified, adapted, rearranged, omitted, or expanded in various ways without deviating from the scope of the present disclosure.

As shown in FIG. 12, at 210, the method 200 may include setting an operating temperature of the indoor portion based on a primary temperature target. The operating temperature generally corresponds to the desired temperature of air within the room. Specifically, the operating temperature may include be a temperature value or range of values that the unit will use as a guideline for activating various components (e.g., the refrigeration loop, fans, and/or heating unit) during a conditioning cycle.

In some embodiments, the primary temperature target provides the temperature value or range of values for the operating temperature at 210. For instance, the primary temperature target may be a preset or predetermined temperature value or range of values based on a selected temperature or level (e.g., a temperature input or relative amount of cooling/heating selected by a user at the control panel). Thus, the primary temperature target may provide an acceptable temperature value or range of values for air exiting the indoor portion of the unit into the room.

In certain embodiments, the primary temperature target includes a pair of discrete limits, such as a primary upper limit and a primary lower limit. The primary upper limit may be a temperature value that is greater than the primary lower limit. Thus, the primary upper limit and the primary lower limit may provide a temperature range that a user may find comfortable or desirable for the selected temperature or level.

At 220, the method 200 may include determining a current or contemporary humidity value (e.g., the humidity value for air at given point in time). Generally, the humidity value may be for the indoor portion of the unit. Specifically, the controller may determine the contemporary humidity based on one or more humidity signals received from the humidity sensor within the indoor portion of the unit.

At 230, the method 200 may include comparing the determined humidity value to a humidity threshold. The humidity threshold may be programmed or predetermined as a maximum desired humidity value or level within the room or the indoor portion of the unit. Thus, 230 may serve to conclude whether the determined humidity value is either greater than the humidity threshold or, alternately, less than or equal to the humidity threshold.

In some embodiments, one or more of 220 or 230 are not performed until after the primary target temperature is met. For instance, the controller may not attempt to compare a contemporary humidity value until the determined temperature is less than or equal to the primary lower limit. Additionally or alternatively, 220 and 230 may be repeated to conclude if subsequent humidity values do or do not exceed the humidity threshold.

At 242, the method 200 may include resetting the operating temperature as a temporary temperature target. In particular, the operating temperature may be reset when the determined humidity value is above (e.g., greater than) the humidity threshold at the indoor portion of the air conditioner. In some such embodiments, the resetting may also require the primary temperature target is reached (e.g., a determination that the contemporary temperature is between the primary upper limit and the primary lower limit, a determination that the contemporary temperature is below the primary upper limit and at or below the primary lower limit, etc.). Moreover, 242 may be performed in response to a 230 comparison in which the determined humidity value exceeds the humidity threshold.

At 244, the method 200 may include maintaining the operating temperature as the primary temperature target. In particular, the operating temperature may be maintained when the determined humidity value at 220 is at or below the humidity threshold. In some such embodiments, maintaining of the operating temperature is performed in response to a 230 comparison in which the determined humidity value is at or below the humidity threshold.

Returning to 242, the temporary temperature target may temporarily replace or supplant the primary temperature target with respect to the operating temperature. For instance, the temporary temperature target may include a pair of discrete limits, such as a temporary upper limit and a temporary lower limit. In some embodiments, the temporary upper limit is a temperature value that is greater than the primary lower limit. For instance, the temporary upper limit may be less than the primary upper limit and greater than the primary lower limit; and the temporary lower limit may be less than the primary lower limit. More specifically, the temporary upper limit may be less than the primary upper limit by a set interval or amount. Similarly, the temporary lower limit may be less than the primary lower limit by a set interval that is the same or different (i.e., greater than or less than) the set interval between the primary upper limit and the temporary upper limit.

In some embodiments, the temporary target temperature varies based on the contemporary temperature value at the point in time in which the humidity threshold is exceeded. Specifically, the temporary target temperature may be dependent on whether a determined temperature value is above (e.g., greater than or equal to) or below (e.g., less than) the primary temperature target.

In certain embodiments, the temporary temperature target of 242 is equal to the primary temperature target when the contemporary temperature value is greater than or equal to the primary temperature target. For example, a temporary lower limit may be set as (i.e., equal to) the primary lower limit. The temporary upper limit may be set as the primary upper limit.

In further embodiments, the temporary temperature target of 242 is less than the primary temperature target when the contemporary temperature value is less the primary temperature target. In particular, the temporary temperature target may be set according to the contemporary temperature at the point in time in which the contemporary humidity value exceeds the humidity threshold. In some examples, the temporary temperature target may be set as the contemporary temperature value at the point in time in which the contemporary humidity value exceeds the humidity threshold. In examples wherein there is a temporary upper limit and a temporary lower limit, the temporary lower limit may be set as (i.e., equal to) the contemporary temperature value at the point in time in which the contemporary humidity value exceeds the humidity threshold. The temporary upper limit may be set as another temperature value that is greater than the lower temporary limit.

In certain embodiments, the method 200 returns the operating temperature to the primary target temperature after 242. For instance, after resetting the operating temperature at 242, 220 and 230 may be repeated to conclude if subsequent humidity values do or do not exceed the humidity threshold. In other words, the method 200 may include determining a new humidity value after the first determining of the contemporary humidity value at 220, and comparing the new humidity value to the humidity threshold. When the new humidity value is at or below the humidity threshold (e.g., in response to such a determination), the method 200 may provide for returning the operating temperature target to the primary temperature target.

At 250, the method 200 may include directing refrigerant compression at the compressor based on the operating temperature. For instance, the compressor may be activated according to a cooling routine, heating routine, or a dehumidification routine, as described above. Thus, 250 may include motivating refrigerant through the sealed refrigeration loop according to the operating temperature at a particular period of time.

In some embodiments, 250 may direct the compressor to be activated in order to achieve or maintain an air temperature within the indoor portion that is within the limits of the operating temperature. If the operating temperature is set as the primary temperature target, those limits may be the primary upper limit and the primary lower limit. If the operating temperature is set as the contemporary temperature target, those limits may be the temporary upper limit and the temporary lower limit. Thus, 250 may occur after 210, 242, and/or 244. Moreover, 250 may be repeated or performed continuously throughout operation (e.g., of a cooling mode or a heating mode). In other words, 250 may begin between 210 and 220, but continue or repeat until after 242 or 244.

As noted above, 250 may be performed as part of a cooling routine, heating routine, and/or dehumidification routine. For instance, in a cooling or heating routine including 250, the unit may initiate the routine based on the operating temperature (e.g., the operating temperature at the time of initiating a cooling routine). Upon initiating the routine, one or more thermal operations are performed by the unit. As an exemplary thermal operation, compression of the refrigerant within the loop may be directed (e.g., by activating the compressor to rotate at a first compressor speed). As the refrigerant is compressed, a refrigerant cycle or a heat pump cycle may be performed through the refrigeration loop, as described above. As an additional or alternative thermal operation, a make-up airflow may be directed at a first blower speed (e.g., rotational velocity of the auxiliary fan and/or blower fan of the indoor portion).

Before and/or during such thermal operations, a current or contemporary temperature value (e.g., the temperature value for air at given point in time) may be determined. Generally, the temperature value may be for the indoor portion of the unit. Specifically, the controller may determine the contemporary temperature value based on one or more temperature signals received from the temperature sensor within the indoor portion of the unit. The determined temperature value may be compared to the operating temperature (e.g., the primary temperature target). Some or all of the thermal operations may be continued and/or adjusted based on the comparison. Moreover, the determination and comparison may be repeated (e.g., at predetermined interval) such that a feedback loop is performed to ensure make-up air meets the operating temperature.

As an example, if the determined temperature value is greater than the primary upper limit during a cooling mode, the unit may direct thermal operations and continue to determine subsequent temperature values. Thermal operations may be halted or limited in response to at least one determined temperature value being equal to or less than the primary lower limit. In other words, thermal operations may continue until the air within the indoor portion of the unit is at or below the primary lower limit. Although thermal operations may be halted or limited, the unit may continue to determine subsequent temperature values. Thermal operations may be increased or resumed in response to a subsequent temperature value being greater than the primary upper limit. In other words, thermal operations may resume when the air within the indoor portion of unit exceeds the primary upper limit.

When the humidity value within the indoor portion is above the humidity threshold at 230, 250 may be performed as part of a dehumidification routine (e.g., after the operating temperature is reset at 242). For instance, the dehumidification routine including 250 may be performed if the contemporary humidity value exceeds the humidity threshold when the contemporary temperature value is below the primary upper limit and at or above the primary lower limit. The dehumidification routine may include directing refrigerant compression (e.g., directing the rotational velocity of the compressor) at a second compressor speed that is less than the first compressor speed. Additionally or alternatively, the dehumidification routine may include directing a make-up airflow at a second blower speed (e.g., the rotational velocity of the auxiliary fan and/or blower fan of the indoor portion) air temperature within the indoor portion (e.g., the temperature of make-up air) at a second blower speed that is less than the first blower speed.

Once initiated, the dehumidification routine including 250 may generally continue until the contemporary humidity value is less than or equal to the humidity threshold. Once the humidity threshold is reached, the dehumidification routine may end (e.g., such that a cooling routine or heating routine is resumed). Additionally or alternatively, the dehumidification routine may end when the contemporary temperature level is not within the operating temperature. For example, if the contemporary temperature value rises above the upper temporary limit during the dehumidification routine (e.g., before the contemporary humidity value falls below the humidity threshold), the thermal operations may be resumed. Such thermal operations continue until the contemporary temperature value is less than or equal to the temporary lower limit. Optionally, if the contemporary temperature value falls significantly below the temporary lower limit (e.g., below a minimum temperature band, such as five degrees Fahrenheit) during the dehumidification routine, the heater unit (e.g., at the heater banks), may be activated to supply additional heat to the dehumidified make-up air.

As shown in FIG. 15, at 510 the method 500 may include receiving a temperature input. For instance, temperature input may be received as a signal from the control panel corresponding to a temperature desired by a user, as described above.

At 520, the method 500 may include setting an operating temperature as a primary upper limit and a primary lower limit. In particular, the primary limits may be based on the temperature input at 510. the primary temperature target may be a preset or predetermined temperature value or range of values based on a selected temperature or level (e.g., a temperature input or relative amount of cooling/heating selected by a user at the control panel). Thus, the primary temperature target may provide an acceptable temperature value or range of values for air exiting the indoor portion of the unit into the room. Optionally, the primary upper limit may be a temperature value that is greater than the primary lower limit. Thus, the primary upper limit and the primary lower limit may provide a temperature range that a user may find comfortable or desirable for the selected temperature or level.

At 530, the method 500 may include evaluating a temperature value at an indoor portion of the appliance. In particular, the temperature value may be determined for air at a given point in time within the indoor portion of the unit. The controller may determine the contemporary temperature value based on one or more temperature signals received from the temperature sensor within the indoor portion of the unit. The determined temperature value may then be compared to the operating temperature. If the determined temperature value is below the upper limit or the lower limit of the operating temperature (e.g., the primary limits), the method 500 may proceed to 540. If the determined temperature is not below the upper limit or the lower limit, the method 500 may proceed to 535.

At 535, the method may include directing refrigerant compression based on the operating temperature. For instance, the compressor may be activated according to a cooling routine or a heating routine, as described above. Thus, 535 may include motivating refrigerant through the sealed refrigeration loop according to the operating temperature at a particular period of time. In some embodiments, 535 may direct the compressor to be activated in order to achieve or maintain an air temperature within the indoor portion that is within the upper and lower limits of the operating temperature. If the operating temperature is set as the primary temperature target, those limits may be the primary upper limit and the primary lower limit.

Upon initiating the routine, one or more thermal operations are performed by the unit. As an exemplary thermal operation, compression of the refrigerant within the loop may be directed (e.g., by activating the compressor to rotate at a first compressor speed). As the refrigerant is compressed, a refrigerant cycle or a heat pump cycle may be performed through the refrigeration loop, as described above. As an additional or alternative thermal operation, a make-up airflow may be directed at a first blower speed (e.g., rotational velocity of the auxiliary fan and/or blower fan of the indoor portion).

After initiating or completing 535, the method 500 may return to 530 (e.g., such that the temperature is adjusted according to a feedback loop).

At 540, the method 500 may include determining a humidity value (e.g., the humidity value for air at given point in time). Generally, the humidity value may be for the indoor portion of the unit. Specifically, the controller may determine the contemporary humidity based on one or more humidity signals received from the humidity sensor within the indoor portion of the unit.

At 550, the method may include comparing the determined humidity value to a humidity threshold. The humidity threshold may be programmed or predetermined as a maximum desired humidity value or level within the room or the indoor portion of the unit. Thus, 550 may serve to conclude whether the determined humidity value is either greater than the humidity threshold or, alternately, less than or equal to the humidity threshold. If the determined humidity value is below the humidity threshold, the method may proceed to 564. By contrast, if the determined humidity value is not below the humidity threshold, the method may proceed to 562.

At 562, the method may include resetting the operating temperature as a temporary temperature target. In particular, the operating temperature may be reset as a temporary upper limit and a temporary lower limit. In some such embodiments, 562 confirms that temporary limits had not been previously set. For example, 562 may require determining if a humidity flag for the temporary limits had been set as active. An active flag will indicate temporary limits had been previously set and that those temporary limits are currently being used for the operating temperature.

In certain embodiments, the temporary temperature target of 562 is equal to the primary temperature target when the contemporary temperature value of 530 is greater than or equal to the primary temperature target. For example, a temporary lower limit may be set as (i.e., equal to) the primary lower limit of 520. The temporary upper limit may be set as the primary upper limit of 520.

In further embodiments, the temporary temperature target of 562 is less than the primary temperature target when the contemporary temperature value is less the primary temperature target. In particular, the temporary temperature target may be set according to the contemporary temperature at the point in time in which the contemporary humidity value exceeds the humidity threshold (e.g., at 530). In some examples, the temporary temperature target may be set as the contemporary temperature value at the point in time in which the contemporary humidity value exceeds the humidity threshold. The temporary lower limit may be set as (i.e., equal to) the contemporary temperature value at 530. The temporary upper limit may be set as another temperature value that is greater than the lower temporary limit.

After the operating temperature is established as the temporary upper limit and the lower limit, the method 500 may proceed to 565.

At 565, the method may include directing refrigerant compression based on the determined humidity value or the operating temperature. For instance, the compressor may be activated according to a cooling routine, a heating routine, or a dehumidification routine, as described above.

When based on the determined humidity value, for instance, 565 may be part of a dehumidification routine. For instance, the dehumidification routine may be performed when the contemporary humidity value exceeds the humidity threshold and the contemporary temperature value is below the primary upper limit. The dehumidification routine may include directing refrigerant compression (e.g., directing the rotational velocity of the compressor) at a second compressor speed that is less than the first compressor speed. Additionally or alternatively, the dehumidification routine may include directing a make-up airflow at a second blower speed (e.g., the rotational velocity of the auxiliary fan and/or blower fan of the indoor portion) air temperature within the indoor portion (e.g., the temperature of make-up air) at a second blower speed that is less than the first blower speed.

When based on the operating temperature, 565 may include motivating refrigerant through the sealed refrigeration loop according to the operating temperature at a particular period of time. In some embodiments, 565 may direct the compressor to be activated in order to achieve or maintain an air temperature within the indoor portion that is within the upper and lower limits of the operating temperature. If the operating temperature is set as the primary temperature target, those limits may be the primary upper limit and the primary lower limit.

Compression of the refrigerant within the loop may be directed (e.g., by activating the compressor to rotate at a first compressor speed). As the refrigerant is compressed, a refrigerant cycle or a heat pump cycle may be performed through the refrigeration loop, as described above. Additionally or alternatively, a make-up airflow may be directed at a first blower speed (e.g., rotational velocity of the auxiliary fan and/or blower fan of the indoor portion).

After initiating or completing 565, the method 500 may return to 530 (e.g., such that the temperature is adjusted according to a feedback loop).

Returning to 564, at 564, the method may include maintaining the operating temperature as the primary temperature target. In particular, the operating temperature may be maintained when the determined humidity value at 540 is at or below the humidity threshold. The humidity flag may be set as inactive and the operating temperature may be returned to the primary limits before the method 500 is returned to 530.

Figure 13:
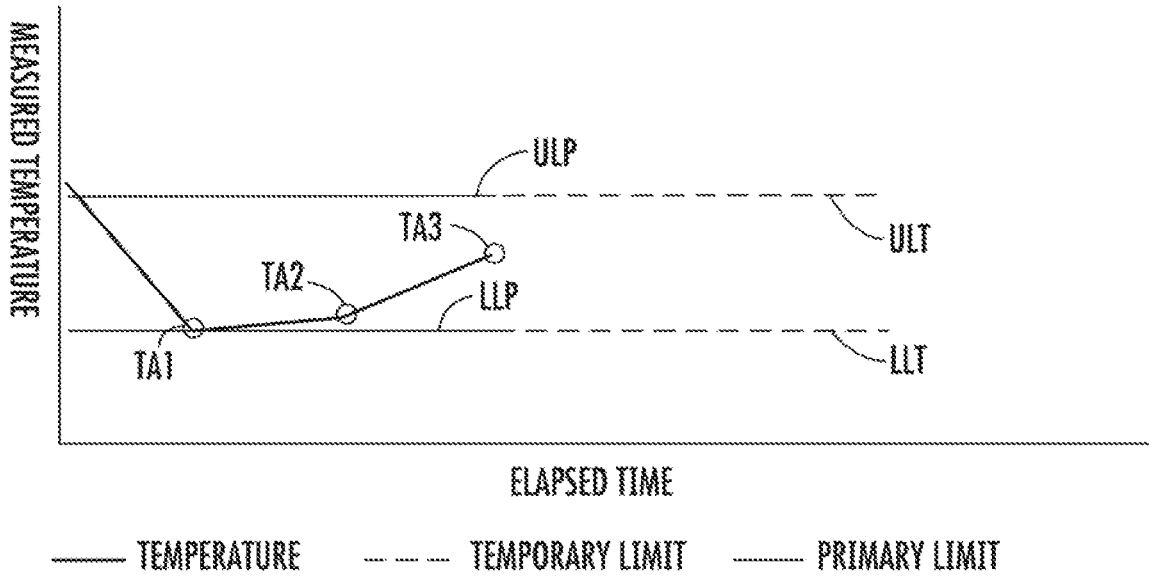
FIG. 13 provides a graph illustrating a temperature measured over elapsed time according to multiple temperature criteria.
Figure 14:
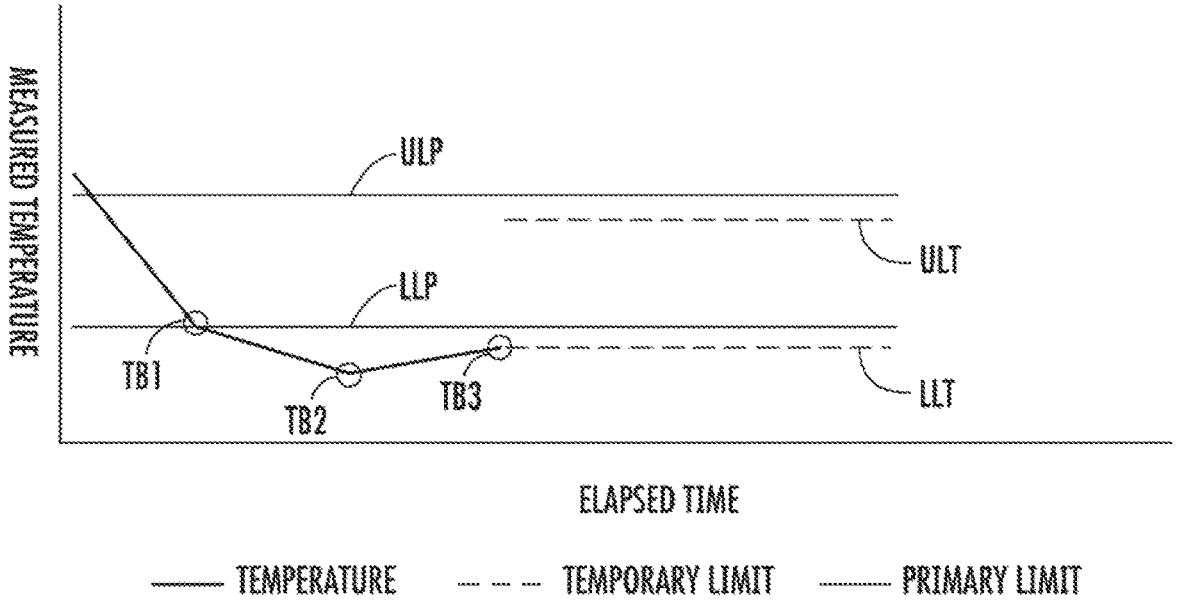
FIG. 14 provides a graph illustrating a temperature measured over elapsed time according to multiple temperature criteria.

Turning to FIGS. 13 and 14, graphs illustrating an exemplary conditioning cycle are provided. Specifically, each graph charts a temperature measured (e.g., at the temperature sensor 110—FIG. 3) over elapsed time (e.g., in seconds) and controlled according to an operating temperature having an upper and a lower limit. In such embodiments, controller 84 (FIG. 3) is configured to activate or control refrigeration loop 48 (FIG. 3) based on the humidity detected at humidity sensor 112 (FIG. 3) and the temperature detected at temperature sensor 110 (FIG. 3). For instance, controller 84 may be configured to initiate a conditioning cycle that includes a cooling mode.

In FIG. 13, the measured temperature values decline as the controller 84 directs the unit 10 to perform one or more thermal operations as air is cooled toward a primary lower limit LLP. For example, the controller 84 may initiate the compressor 34 (FIG. 3) to operate the refrigeration loop 48 and cool air through the unit 10. At point TA1, the primary lower limit LLP is satisfied (i.e., the measured temperature value TA1 is less than or equal to the primary lower limit LLP) and the compressor 34 may be deactivated (or the speed may be reduced). Any further thermal operations of (e.g., of a cooling routine) may be ceased or adjusted. The measured temperature may be permitted to increase (e.g., until the primary upper limit ULP is reached).

At the point TA1, the controller 84 may also begin to measure the humidity (e.g., at the humidity sensor 112). If the measured humidity value is above a predetermined humidity threshold, the unit 10 may perform a dehumidifying routine. Specifically, a portion of the refrigeration loop 48 may be activated until the humidity threshold is no longer exceeded, such as at TA2. Once the humidity threshold is no longer exceeded, the refrigeration loop 48 may be deactivated while the controller 84 continues to repeatedly monitor or measure humidity values and temperature values.

If the controller 84 determines that the humidity value exceeds the humidity threshold at a subsequent point (e.g., TA3) in which the temperature is between the primary upper limit ULP and the primary lower limit LLP, the controller 84 may reset the operating temperature as a temporary lower limit LLT and a primary lower limit LLP; the temporary lower limit LLT being equal to the primary lower limit LLP and the temporary upper limit ULT being equal to the primary upper limit ULP.

In FIG. 14, the measured temperature values decline as the controller 84 directs the unit 10 to perform a cooling routine as air is cooled toward a primary lower limit LLP. For example, the controller 84 may initiate the compressor 34 (FIG. 3) to operate the refrigeration loop 48 and cool air through the unit 10. At point TB1, the primary lower limit LLP is satisfied (i.e., the measured temperature value TB1 is less than or equal to the primary lower limit LLP) and the compressor 34 may be deactivated (or the speed may be reduced). Any further thermal operations of the cooling routine may be ceased or adjusted. The measured temperature may be permitted to increase (e.g., until the primary upper limit ULP is reached).

At the point TB1, the controller 84 may also begin to measure the humidity (e.g., at the humidity sensor 112). If the measured humidity value is above a predetermined humidity threshold, the unit 10 may perform a dehumidifying routine. Specifically, a portion of the refrigeration loop 48 may be activated until the humidity threshold is no longer exceeded, such as at TB2. Once the humidity threshold is no longer exceeded, the refrigeration loop 48 may be deactivated while the controller 84 continues to repeatedly monitor or measure humidity values and temperature values.

If the controller 84 determines that the humidity value exceeds the humidity threshold at a subsequent point (e.g., TB3) in which the measured temperature is below the primary lower limit LLP, the controller 84 may reset the operating temperature as a temporary lower limit LLT and a primary lower limit LLP; the temporary lower limit LLT being less than to the primary lower limit LLP and the temporary upper limit ULT being less than to the primary upper limit ULP. In some such embodiments, the temporary lower limit LLT is equal to the temperature value at the point at which the humidity threshold is exceeded (e.g., TB3). In further embodiments, the temporary upper limit ULT is equal to the difference in the primary upper limit ULP and the primary lower limit LLP, plus the temporary lower limit LLT (i.e., ULT=ULP−LLP+LLT).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a packaged terminal air conditioner unit comprising an indoor portion, an outdoor portion, and a compressor in fluid communication between the indoor portion and the outdoor portion, the method comprising:

setting an operating temperature of the indoor portion based on a primary temperature target;

determining a humidity value at the indoor portion;

comparing the determined humidity value to a humidity threshold;

resetting the operating temperature as a temporary temperature target when the determined humidity value is above the humidity threshold and the primary temperature target is reached at the indoor portion of the air conditioner; and directing refrigerant compression at the compressor based on the operating temperature.

2. The method of claim 1, the method further comprising:

maintaining the operating temperature as the primary temperature target when the determined humidity value is at or below the humidity threshold.

3. The method of claim 1, wherein the primary temperature target comprises a primary upper limit and a primary lower limit.

4. The method of claim 1, the method further comprising:

determining a temperature value; and comparing the temperature value to the primary temperature target.

5. The method of claim 4, wherein the temporary temperature target is less than the primary temperature target when the determined temperature value is less than the primary temperature target.

6. The method of claim 5, wherein the primary temperature target comprises a primary upper limit and a primary lower limit, and wherein the temporary temperature target comprises a temporary upper limit and a temporary lower limit, the temporary upper limit being less than the primary upper limit, and the temporary lower limit being less than the temporary lower limit.

7. The method of claim 4, wherein the temporary temperature target is equal to the primary temperature target when the determined temperature value is greater than or equal to the primary temperature target.

8. The method of claim 7, wherein the primary temperature target comprises a primary upper limit and a primary lower limit, and wherein the temporary temperature target comprises a temporary upper limit and a temporary lower limit, the temporary upper limit being equal to the primary upper limit, and the temporary lower limit being equal to the temporary lower limit.

9. The method of claim 1, the method further comprising:

determining a new humidity value after the determining the humidity value;

comparing the new humidity value to the humidity threshold; and returning the operating temperature target to the primary temperature target when the new humidity value is at or below the humidity threshold.

10. The method of claim 9, the method further comprising:

maintaining the operating temperature target as the temporary temperature target when the new humidity value is above the humidity threshold.

11. An air conditioner unit for conditioning an indoor space, comprising:

an outdoor heat exchanger assembly disposed in an outdoor portion and comprising an outdoor heat exchanger and an outdoor fan;

an indoor heat exchanger assembly disposed in an indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger;

a bulkhead disposed between the outdoor heat exchanger and the indoor heat exchanger along a transverse direction, the bulkhead defining the indoor portion and the outdoor portion;

a vent aperture defined in the bulkhead;

a humidity sensor disposed within the indoor portion;

a temperature sensor disposed within the indoor portion; and a controller operably coupled to the compressor, the controller being configured to initiate a conditioning cycle comprising setting an operating temperature of the indoor portion based on a primary temperature target, determining a humidity value at the indoor portion based on a signal received from the humidity sensor, comparing the determined humidity value to a humidity threshold, resetting the operating temperature as a temporary temperature target when the determined humidity value is above the humidity threshold and the primary temperature target is reached at the indoor portion, and directing refrigerant compression at the compressor based on the operating temperature.

12. The air conditioner unit of claim 11, wherein the conditioning cycle further comprises maintaining the operating temperature as the primary temperature target when the determined humidity value is at or below the humidity threshold.

13. The air conditioner unit of claim 11, wherein the primary temperature target comprises a primary upper limit and a primary lower limit.

14. The air conditioner unit of claim 11, wherein the conditioning cycle further comprises determining a temperature value based on a temperature signal received from the temperature sensor, and comparing the determined temperature value to the primary temperature target.

15. The air conditioner unit of claim 14, wherein the temporary temperature target is less than the primary temperature target when the determined temperature value is less than the primary temperature target.

16. The air conditioner unit of claim 15, wherein the primary temperature target comprises a primary upper limit and a primary lower limit, and wherein the temporary temperature target comprises a temporary upper limit and a temporary lower limit, the temporary upper limit being less than the primary upper limit, and the temporary lower limit being less than the temporary lower limit.

17. The air conditioner unit of claim 14, wherein the temporary temperature target is equal to the primary temperature target when the determined temperature value is greater than or equal to the primary temperature target.

18. The air conditioner unit of claim 17, wherein the primary temperature target comprises a primary upper limit and a primary lower limit, and wherein the temporary temperature target comprises a temporary upper limit and a temporary lower limit, the temporary upper limit being equal to the primary upper limit, and the temporary lower limit being equal to the temporary lower limit.

19. The air conditioner unit of claim 11, wherein the conditioning cycle further comprises determining a new humidity value after the determining the humidity value, the new humidity value being based on a new humidity signal received from the humidity sensor, comparing the new humidity value to the humidity threshold, and returning the operating temperature target to the primary temperature target when the new humidity value is at or below the humidity threshold.

20. The air conditioner unit of claim 19, wherein the conditioning cycle further comprises maintaining the operating temperature target as the temporary temperature target when the new humidity value is above the humidity threshold.

* * * * *